US005956061A

United States Patent [19]

Ahn

[11] Patent Number: 5,956,061

[45] Date of Patent: Sep. 21, 1999

[54] INK SUPPLEMENTING DEVICE AND METHOD OF INK CARTRIDGE IN PRINTING APPARATUS

[75] Inventor: Byung-Sun Ahn, Suwon, Rep. of Korea

[73] Assignee: SamSung Electronics Co., Ltd., Kyungki-do, Rep. of Korea

[21] Appl. No.: 08/794,545

[22] Filed: Feb. 3, 1997

[30] Foreign Application Priority Data

Feb. 3, 1996 [KR] Rep. of Korea ..... 96-2628

[51] Int. Cl.[6] ..... B41J 2/195

[52] U.S. Cl. ..... 347/87; 347/7

[58] Field of Search ..... 347/7, 85, 86, 347/87, 23, 29; 73/49.2; 43/42.06

[56] References Cited

U.S. PATENT DOCUMENTS

| | | | |
|---|---|---|---|
| 4,342,042 | 7/1982 | Cruz-Uribe et al. | 347/7 |
| 4,672,842 | 6/1987 | Hasselmann | 73/49.2 |
| 4,968,998 | 11/1990 | Allen | 347/7 |
| 5,070,346 | 12/1991 | Mochizuki et al. | 347/7 |
| 5,280,299 | 1/1994 | Saikawa et al. | 347/87 |
| 5,280,300 | 1/1994 | Fong et al. | 347/87 |
| 5,333,405 | 8/1994 | Bowles | 43/42.06 |
| 5,367,328 | 11/1994 | Erickson | 347/7 |
| 5,409,134 | 4/1995 | Cowger et al. | 222/1 |
| 5,414,452 | 5/1995 | Accatino et al. | 347/7 |
| 5,432,538 | 7/1995 | Carlotta | 347/30 |
| 5,473,350 | 12/1995 | Mader et al. | 347/7 |
| 5,561,448 | 10/1996 | Kaneko et al. | 347/29 |
| 5,565,898 | 10/1996 | Sakuma | 347/23 |

FOREIGN PATENT DOCUMENTS

GM. 8023471 11/1980 Germany ..... B41J 27/00

*Primary Examiner*—N. Le
*Assistant Examiner*—Anh T. N. Vo
*Attorney, Agent, or Firm*—Robert E. Bushnell, Esq.

[57] ABSTRACT

A device prevents ink in an ink cartridge from being supplemented more than a predetermined number of times in a printing apparatus. The device can include a head jetting stored ink on a media, an ink storing unit with rail type guides oppositely provided to both insides thereof and perpendicularly protruded, electrode terminals provided in each lower portion of both guides for sensing whether or not ink in the ink storing unit remains. A sensing actuator can be contacted to both electrode terminals while being guided by guide apertures formed in both sides thereof to move up and down. The sensing actuator can be made of a conductor, and having buoying means for moving the sensing actuator up and down along the surface of ink. The device can also include a resilient mechanism for stably moving the sensing actuator down according to a surface state of ink, a destroying mechanism provided to a lower portion of the ink storing unit and destroying the buoying means upon supplementing ink more than the predetermined number of times to discharge an air pressure, thereby preventing re-use, a sensing sensor connected to both electrode terminals and sensing whether or not the sensing actuator is contacted, a control unit receiving a sensing signal of the sensing sensor to compare the received signal with input data and informing the outside of a state of ink, and an ink cap enclosing an upper portion of the ink storing unit and having an air hole.

18 Claims, 5 Drawing Sheets

INK SUPPLEMENTING DEVICE AND METHOD OF INK CARTRIDGE IN PRINTING APPARATUS

CLAIM OF PRIORITY

This application make reference to, incorporates the same herein, and claims all benefits accruing under 35 U.S.C. §119 from an application entitled INK SUPPLEMENTING DEVICE AND METHOD OF INK CARTRIDGE IN PRINTING APPARATUS earlier filed in the Korean Industrial Property Office on Feb. 3, 1996 and assigned Ser. No. 2628/1996.

BACKGROUND OF THE INVENTION

1. Technical Field

The present invention relates to an ink cartridge used in a printing apparatus using an ink jet device. More particularly, the present invention relates to preventing an ink cartridge from being used more than a predetermined utility life.

2. Background Art

Typically, a printing apparatus using an ink jet device, such as an ink jet printer and a facsimile system, pixel-divides characters to be printed. The printing is done with a dot matrix to electrify ink particles with voltage in proportion to position information of each pixel. Then, the apparatus makes electrified ink particles reach a paper through an electrostatic deflection, thereby printing pixel characters. This printer apparatus can include a carriage which is supported on a main frame to be guided right and left, a head which is attached to the carriage to move together with the carriage and has a nozzle thereon used for jetting ink in a uniform form, and a cleaner for cleaning the head according to a cleaning signal of a constant period upon a printing. On this matter, exemplars of the contemporary practice include Sakuma (U.S. Pat. No. 5,565,898, *Ink Ejecting Printer Having Different Cleaning Timings*, Oct. 15, 1996) discusses an ink ejecting printer capable of increasing a printing speed by eliminating unnecessary head maintenance operations. The printer includes a mode controller, a ROM, timing value storage, a wiping ordering unit and a suction ordering unit. Kaneko (U.S. Pat. No. 5,561,448, *Ink Jet Recording Apparatus For Recovering Recording Head*, Oct. 1, 1996) discusses an ink jet recording apparatus which records by discharging ink onto a recording medium. The apparatus includes a recording head for recording on the recording medium by discharging in through discharge ports. Carlotta (U.S. Pat. No. 5,432,538, *Valve For An Ink Jet Printer Maintenance System*, Jul. 11, 1995) discusses a valve for use in a maintenance station for an ink jet printer. The maintenance station has a carriage on which a cap that selectively seals the printhead nozzle. Accatino et al. (U.S. Pat. No. 5,414,452, *Recognition Of Ink Expiry In An Ink Jet Printing Head*, May 9, 1995) discusses ink jet printers in which the printing head is connected to an ink reservoir, such as can be used in teleprinter or facsimile apparatuses. This permits to foresee the expiry of the ink in the reservoir in order to be able in due time to replace the printing head or the pertinent cartridge. Cowger et al. (U.S. Pat. No. 5,409,134, *Pressure-Sensitive Accumulator For Ink-Jet Pens*, Apr. 25, 1995) discusses an accumulator which regulates changes in the back pressure of an ink-jet pen reservoir so that ink does not leak from the pen print head and so that the print head is able to completely empty the reservoir of ink. Fong et al. (U.S. Pat. No. 5,280,300, *Method And Apparatus For Replenishing An Ink Cartridge*, Jan. 18, 1994) discusses a method and apparatus for refilling collapsible ink bags which are maintained at sub-atmospheric pressure within such equipment. Saikawa et al. (U.S. Pat. No. 5,280,299, *Ink Filling Method For Ink Jet Recording Apparatus*, Jan. 18, 1994) discusses an ink jet head cartridge includes an ink container and a porous material for retaining the ink.

In particular, one must be concerned that if the ink cartridge is used more than the life thereof, the head has already been in the damaged state, and the printing is performed in this state, a bad image is printed. From my study of the above mentioned exemplars of the contemporary practice and the art, I find that there is a need for an effective device and method for preventing ink in the ink jet cartridge from being supplemented more than a predetermined number of times.

SUMMARY OF THE INVENTION

Accordingly, an object of the present invention is to provide an improved ink cartridge used in a printing apparatus using an ink jet device.

Another object is to provide a device and method for preventing ink in the ink jet cartridge from being supplemented more than a predetermined number of times.

Another object is to provide an improved printing apparatus capable of preventing deterioration of an image quality by preventing an ink cartridge from being used more than a predetermined utility life.

Another object of the present invention is to provide a printing apparatus capable of instructing an exchange of an ink cartridge used for an image formation and preventing of deterioration of image quality by preventing an ink cartridge from being used more than a predetermined utility life.

An another object of the present invention is to provide a buoying mechanism of the sensing actuator having stronger buoyancy than a resilience of resilient mechanism in a situation when air is filled in the cartridge.

To achieve these and other advantages and in accordance with the purpose of the present invention, a device for preventing ink in an ink cartridge from being supplemented more than a predetermined number of times in a printing apparatus, can be constructed with a head jetting stored ink on a media; an ink storing unit with rail type guides oppositely provided to both insides thereof and perpendicularly protruded; electrode terminals provided in each lower portion of both guides for sensing whether or not ink in the ink storing unit remains; and a sensing actuator contacted to both electrode terminals while being guided by guide apertures formed in both sides thereof to move up and down, made of a conductor, and having buoying a mechanism for moving the sensing actuator up and down along the surface of ink. The device can also have a resilient mechanism for stably moving the sensing actuator down according to a surface state of ink; a destroying mechanism provided to a lower portion of the ink storing unit and destroying the buoying mechanism upon supplementing ink more than the predetermined number of times to discharge an air pressure, thereby preventing re-use; a sensing sensor connected to both electrode terminals and sensing whether or not the sensing actuator is contacted; a control unit receiving a sensing signal of the sensing sensor to compare a received signal with input data and informing of a state of ink; and an ink cap enclosing an upper portion of the ink storing unit and having an air hole.

To achieve these and other advantages and in accordance with the purpose of the present invention, a method preventing ink in an ink cartridge from being supplemented more than a predetermined number of times in a printer, by receiving a signal to compare it with input data by a control unit, when ink does not remain in an ink cartridge; receiving a signal of the control unit to decide whether or not a printing has to be performed, when ink remains in the ink cartridge; and the ending process when a normal printing is performed. The method can also include the steps of counting the printing number of sheets when ink in the ink cartridge reaches a predetermined ink supplement a number of times; receiving an output signal of the control unit to count a supplement number of times of ink and deciding whether counted result is within the predetermined supplement number limit or more than the predetermined supplement number of times to send a signal to the control unit; receiving a signal indicative of the printing number of sheets to stop an engine for printing when the counted result is within the supplement number limit of ink; and receiving a stop signal of the engine to supplement ink or exchange the ink cartridge.

BRIEF DESCRIPTION OF THE DRAWINGS

The accompanying drawings, which are included to provide a further understanding of the invention and are incorporated in and constitute a part of the specification, illustrate embodiments of the invention and together with the description serve to explain the principles of the invention.

In the drawings.

DETAILED DESCRIPTION OF PREFERRED EMBODIMENT

Reference will now be made in detail to the preferred embodiments of the present invention, examples of which are illustrated in the accompanying drawings.

Usually, if a print signal is input to the printer, the carriage installed on the main frame moves right and left and simultaneously with this, the head moves right and left. Thereby, ink is jetted in the uniform form through the nozzle formed on the head to be printed on a paper to be delivered. Regarding supplement of ink, in case that the ink cartridge and the head for jetting ink are separated from each other, a method of exchanging only the ink cartridge is used, and on the other hand, in case that the ink cartridge and the head are formed in one body, a method of exchanging one body as a whole is used.

Accordingly, the ink cartridge separated from the head has a complicated structure for a long life of the head and therefore, it has a high cost and is manufactured in a largescale. In case of using this ink cartridge, the life of the head is estimated only by an image. In estimating the life of the head only by the image, there is a probability of erroneously estimating the life of the head, and further in case that the head is damaged in a situation when ink remains, a transmitting party's facsimile system judges that information is correctly transmitted to a receiving party's facsimile system, and the receiving party's facsimile system also receives a print command of all data from a control unit to perform a printing operation. However, substantially, there can occur a problem that received data can not be printed due to a damaged head. Furthermore, the ink cartridge formed in one body with the head has a simple structure, and there are one-time ink cartridge and several-times ink cartridge. In this ink cartridge, the life of the head is also estimated only by the image.

Accordingly, even in case of using the ink cartridge formed in one body with the head, there occurs the same problem as in a case of using the ink cartridge separated from the head. Besides, in the several-times ink cartridge, if ink is supplemented more than the predetermined ink supplement number of times, there is a problem generating the bad image due to the damaged head. This is because that the predetermined ink supplement number of times is the utility life of the ink cartridge formed in one body with the head.

Figure 1:
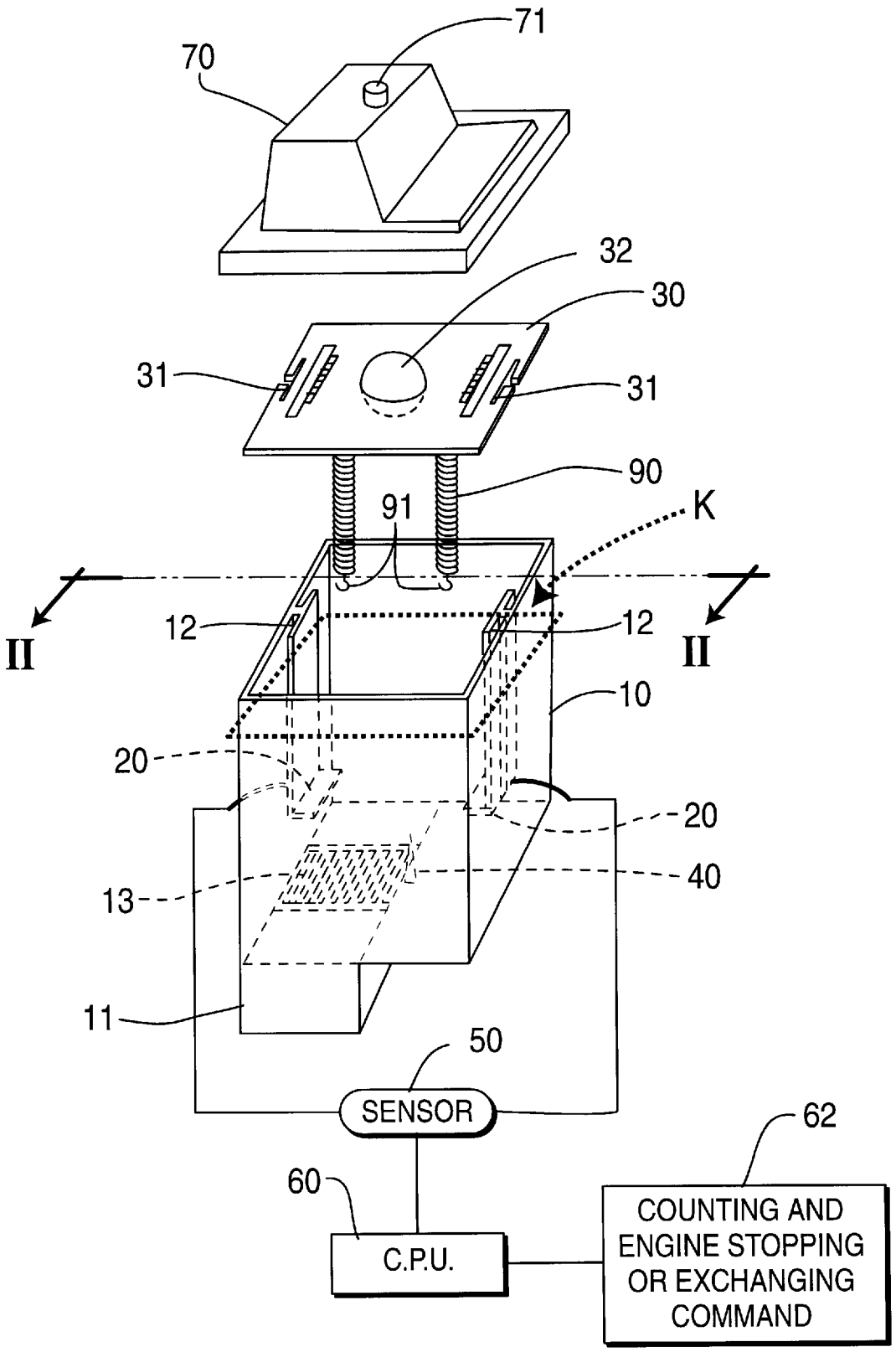
FIG. 1 is a perspective view of an ink cartridge in accordance with the present invention.
Figure 2:
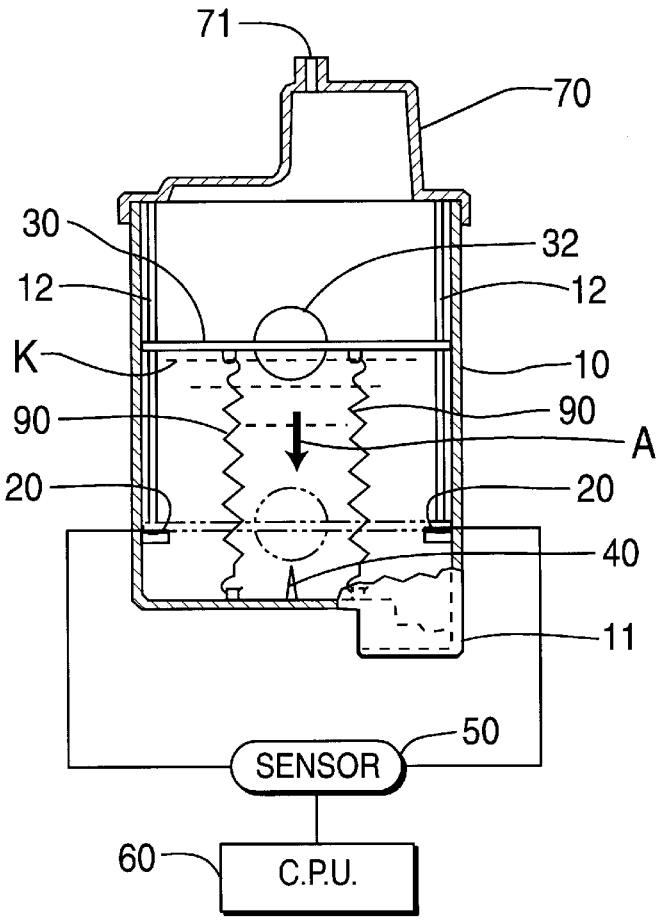
FIG. 2 is a sectional view of an ink cartridge in accordance with the present invention.
Figure 3:
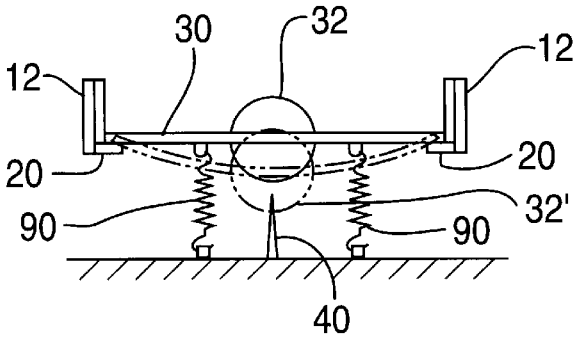
FIG. 3 is a view showing a main part of an ink cartridge in accordance with the present invention.

FIGS. 1 to 3 show one ink cartridge in accordance with the present invention. FIG. 2 is a cross section along plane II of FIG. 1. Herein, the ink cartridge includes an ink storing unit 10 having a head 11. The head 11 heats ink to generate bubbles and jets ink as a volume corresponding to the vapor pressure through a vapor pressure of bubbles, thereby forming an image on a printing paper. This is well known art and accordingly, a detailed explanation thereof and drawing therefor will not be provided.

The ink storing unit 10 having the head 11 is filled with ink K for an image formation, and rail guides 12 are formed in both inner sides thereof which are oppositely provided to each other and perpendicularly protruded. The surface of ink K will move down in the direction of arrow A as the ink is being used (FIG. 2). Further, electrode terminals 20 for sensing whether or not ink K remains is provided in each lower portion of the rail guides 12, and the electrode terminals 20 are electrically connected to the sensing sensor 50 installed to an outside of the ink cartridge. For example, in a printer, the ink cartridge is installed to a carriage and upon a supplement of or exchange, is separated from the carriage. Thus, if the ink cartridge is installed to the carriage, the electrode terminals 20 are contacted to the terminals of the carriage to be electrically connected to the sensing sensor 50 which is connected to the terminals.

A sensing actuator 30, which is guided by the rail guides 12 to move up and down, is installed to an inside of the ink storing unit 10. Guide apertures 31 in which rail guides 12 are inserted is formed on the sensing actuator 30 made of conductor. Accordingly, if the sensing actuator 30 moves down, it is contacted with electrode terminals 20 and thereby, a contact signal of electrode terminals 20 is transmitted to the sensing sensor 50. Moreover, a buoying means is provided on the sensing actuator 30. It is desired that the buoying means is formed in a buoyant globe 32 in which air pressure is charged, and this buoyant globe 32 is made of a thin vinyl resin so as to be easily destroyed by destroying means. The buoyant globe 32 is used for making the sensing actuator 30 float on the surface of ink K through a buoyancy thereof.

Further, the sensing actuator 30 was designed to be drawn in a direction of an ink filter 13 by resilient means to stably move down. Herein, it is desired that the aforesaid resilient means is made of a tension coil spring, and these tension coil springs 90 are respectively fixed to the sensing actuator 30 and a bottom surface of the ink storing unit 10 at ends thereof and thereby tension for making the sensing actuator move down is applied.

The resilient means can include any material having tension such as an elastic, except for the tension coil spring, and then the tension thereof has to be weaker than the buoyancy of the buoyant globe 32 for making the sensing actuator 30 float on the surface of ink K. The tension coil springs 90 have spring hooks 91 at the bottoms. Herein, because the sensing actuator 30 is used as surface sensing mechanism for correctly sensing the surface of ink K, if the tension of the tension coil springs 90 is stronger than the buoyancy of the buoyant globe 32, the sensing actuator 30 is positioned in a lower place than the surface of ink K and accordingly, the sensing actuator 30 can not perform the correct surface sensing function. The destroying mechanism capable of destroying the buoying mechanism is provided to the lower portion of the ink storing unit 10 and then, it is desired that the destroying mechanism 40 is formed in a form of a pointed spine. In installing the destroying spine 40, the end thereof has to be positioned in lower place (about 1.5–2 cm) than that of the buoyant globe 32 when the sensing actuator 30 moves down to be contacted with the electrode terminal 20 and thereby, it can not move down any more. These are controlled by control unit 60, which is frequently a central processing unit (C.P.U.) and which can be attached to an operation unit 62 permitting actuation of counting and engine stopping or exchanging commands.

Figure 4:
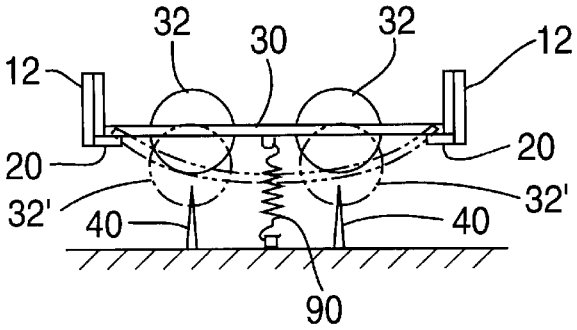
FIG. 4 is a view showing another part of another ink cartridge in accordance with another embodiment of the present invention.

FIGS. 3 and 4 show examples of an operation state of the buoying mechanism, resilient mechanism, and destroying mechanism. That is, in case that a single buoyant globe 32 that is a buoying mechanism is provided to the sensing actuator 30, the tension coil springs 90 are respectively installed to both sides of the buoyant globe 32 for a stable operation, and each destroying spine 40 has to be provided corresponding to the number of the buoyant globe 32.

However, in case that two buoyant globes 32 are provided so that the sensing actuator 30 can float on the surface of ink K, one tension coil spring 90 is installed in a middle and two destroying spines are provided.

An ink cap 70 enclosing the ink storing unit 10 has an air hole 71 through which air can flow in order to maintain the pressure of the inside. The air hole 71 is usually used as the hole through which the air can flow freely, but upon supplementing ink, it is used as an ink injecting hole. Here, since a diameter of a needle of the injector used for supplementing ink is as small as that of the injection needle, the diameter of the air hole 71 is so small that ink K can not escape.

A control unit 60, which can be a central processing unit, receives a signal of the sensing sensor 50 to display an ink supplement or an ink cartridge exchange command or controls an engine stopping command or the command for stopping an engine after printing the predetermined number of sheets.

Operation in accordance with the present invention is now explained with reference to FIGS. 2 and 3.

If the current is applied to the electrode of the head 11 according to an initial printing signal, a heating plate is heated and then vapor pressure is generated, and bubbles in the vicinity of the heating plate are then generated due to the generated vapor pressure. If ink corresponding to a volume change according to a growth of bubbles is jetted through an opening, ink of the ink storing unit 10 is transferred to a fine channel due to an osmatic pressure action and thereby, a printing is performed. According to a progress of the printing, ink K of the ink storing unit 10 is exhausted to be gradually reduced.

Accordingly, the sensing actuator 30 floating on the ink surface of the ink storing unit 10 through the buoyancy of the buoyant globe 32 moves down along the ink surface to be reduced simultaneously with ink being exhausted. At this time, the guides apertures 31 formed in both sides of the sensing actuator 30 are guided by the guides 12 provided in both sides of the ink storing unit 10 to be perpendicularly moved down. Then, in the inside of the ink storing unit 10, there occurs a drop in a pressure due to a exhaustion of ink, but on the other hand, since the pressure of the inside of the ink storing unit 10 has to be constantly maintained for a smooth supplement of ink, the air is injected to the inside of the ink storing unit 10 through the air hole 71 of the ink cap 70 so that the pressure of the inside is maintained to an atmosphere state. At this time, since the pressure of the inside of the ink storing unit 10 is constantly maintained, ink is smoothly jetted and the printing is performed.

If ink is gradually exhausted according to repeat of the above-mentioned process, the sensing actuator 30 is contacted with electrode terminals provided in each lower portion of the guides 12. Accordingly to this, the sensing sensor 50 senses this to transmit the sensing signal to the control unit 60 and then, the control unit 60 receives the sensing signal to compares it with input data and Informs the outside of the exhaustion state of ink. That is, the control unit 60 displays the ink supplement command and at the same time, instructs an engine stopping command.

At this time, ink within the ink storing unit 10 is supplemented and according to this, the sensing actuator 30 moves up along the surface of ink K gradually rising through the buoyancy of the buoyant globe 32. And, the sensing actuator 30 is separated from the electrode terminals 20 due to a rising action of the sensing actuator 30 and thereby, the control unit 60 can actuate the engine, thereby performing the normal printing.

In the meantime, if ink K is not supplemented to the ink storing unit 10, since the sensing actuator does not move up and continues to be in the contact with the electrode terminals 20, the control unit 60 does not actuates the engine and thereby, the engine does not operate until the ink cartridge is supplemented with ink or exchanged with the new ink cartridge. The process is illustrated with depiction of movement with speculative positions of floats 32'—such as in FIGS. 3 and 4. Accordingly, in the present invention, there is not generated conventional problems such as a printing of a bad image. Meanwhile, the ink cartridge can be made as a one-time ink cartridge or as a several-times cartridge. Accordingly, in case of the one-time ink cartridge being used, only if the ink cartridge is exchanged for the new one, there is no problem, but, in case of the several times ink cartridge being used, the system has to be controlled by the control unit 60 with previously input data.

Figure 5:
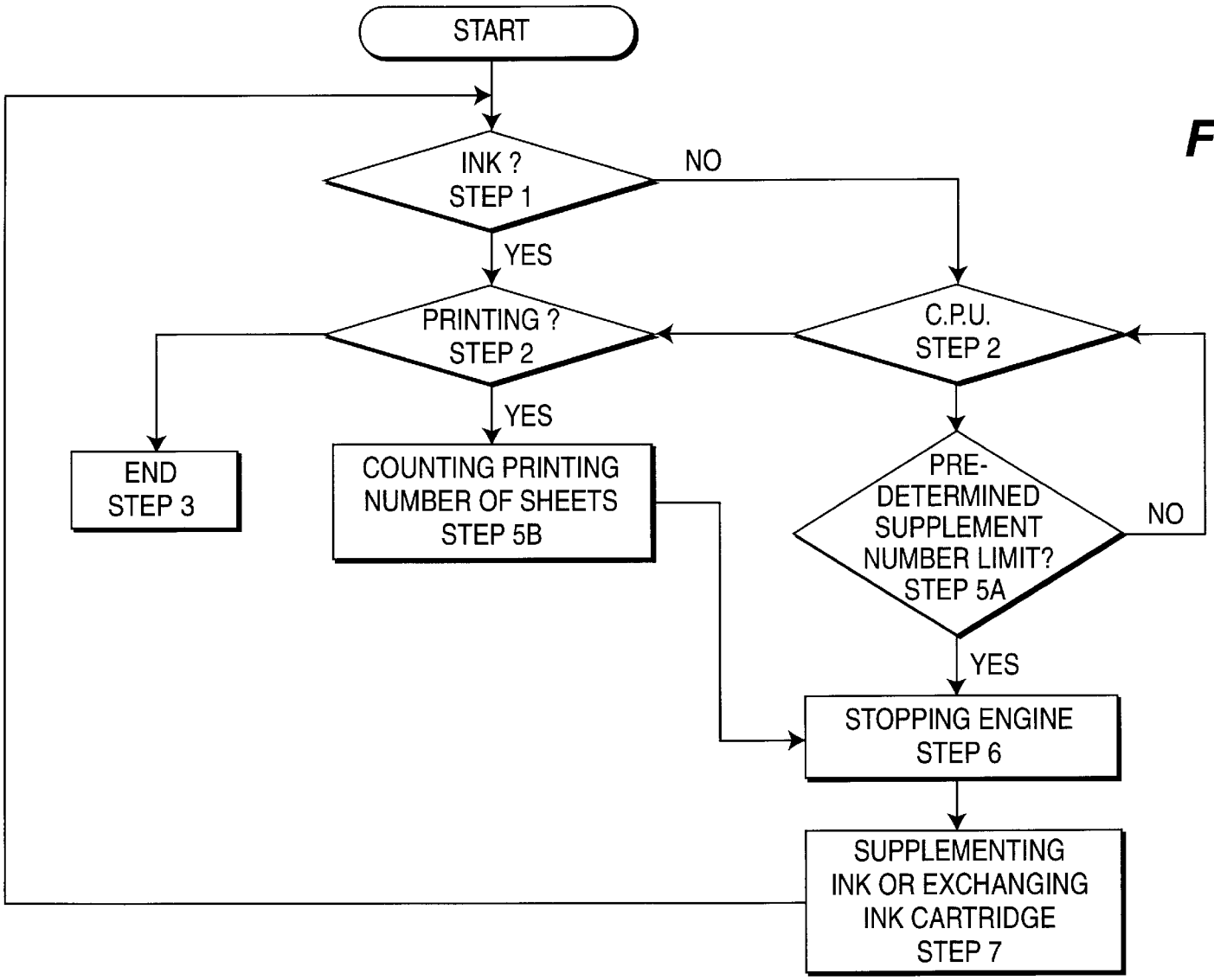
FIG. 5 is a flow chart illustrating a method of preventing ink in an ink cartridge from being supplemented more than predetermined number of times according to the present invention.

FIG. 5 shows a flow chart illustrating a method of preventing the ink cartridge from being supplemented more than the predetermined number of times. In FIG. 5, step 1 decides whether or not ink remains in the ink storing unit 10, and step 2 decides to perform the printing under the signal of the control unit 60 if there are ink. And together, the printing is normally performed in a situation when ink remains in the ink cartridge. Step 3 ends after the normal printing and at this time, the engine is not stopped. If ink in the ink cartridge is exhausted and thereby it is decided that ink does not remain in step 1, the control unit 60 receives this to compare it with input data and controls the next step. Obviously, Step 4 depicts this using the central processing unit to calculate and compare to decide whether to send to printing decision Step 2 or not. If not, then the flow chart moves to Step 5A. Step 5A receives an output signal of the control unit 60 to decide whether or not it is within the predetermined supplement number limit of ink, and if it is, the engine is stopped in step 6 under a control of the control unit 60. Then ink cartridge is in a state that ink therein is exhausted and accordingly, the sensing actuator 30 is in contact with the electrode terminals 20. Further, in this state, the engine is stopped and therefore, ink is not exhausted any more. So, the buoyant globe 32 of the sensing actuator 30 is not destroyed by the destroying spine 32 and also, in case that ink is supplemented, the sensing actuator 30 moves up and therefore, it becomes possible to re-use the ink cartridge. Step 6 is the engine stopping step for a supplement of ink or the exchange, and step 7 receives an engine stop signal to supplement ink or exchange the ink cartridge. Then, if the ink cartridge was not used up to the predetermined number of times, the message indicating that ink can continuously be supplemented is sent to the user. On the other hand, if the life of the ink cartridge reached the predetermined number of times, the message indicating that the ink cartridge can not be used any more and it has to be exchanged with the new one is sent to the user. As mentioned above, if the ink is supplemented or the ink cartridge is exchanged, the system goes to the normal operation state of step 1. If the life of the ink cartridge reaches the predetermined ink supplement number limit in step 5A, the engine is not immediately stopped and instead of it, step 5 is performed through steps 4 and 2. Step 5B is a step of counting the printing number of sheets for continuously exhausting ink in the ink cartridge in case that the life of the ink cartridge reaches the predetermined ink supplement number of times. Before the step of counting the printing number of sheets is performed, the sensing actuator 30 is in contact with the electrode terminals 20 as shown in FIGS. 3 and 4 and therefore, the buoyant globe 32 is not contacted with the destroying spine 40.

But, if the printing number of sheets counting step is performed, predetermined sheets of printing papers are additionally printed. Accordingly, ink K is more exhausted and the surface thereof is positioned under the electrode terminals 20. Thus, since a middle part of the sensing actuator 30 goes down due to the tension of the tension coil spring 90 and the buoyant globe 32 moves down, the buoyant globe 32 is contacted to the destroying spine 40 to be destroyed. If the buoyant globe 32 is destroyed, since the buoyancy is not acted to the sensing actuator 30, the sensing actuator 30 can not move up in spite of ink being supplemented.

Accordingly, in case of using the ink cartridge in which the buoyant globe 32 is destroyed, since the printer continues to stay in the engine stop step, if the ink cartridge being used is not exchanged with a new ink cartridge, the printer is in an unavailable state and accordingly, it is inevitable to exchange the ink cartridge with the new one.

As illustrated in FIG. 5, a method of preventing ink in an ink cartridge from being supplemented more than a predetermined number of times in a printer can be used. This includes the steps of receiving a signal to compare it with input data by a control unit, when ink does not remain in an ink cartridge, receiving a signal of said control unit to decide whether or not a printing has to be performed, when ink remains in the ink cartridge, and ending process when a normal printing is performed. This can also include the steps of counting the printing number of sheets when ink in the ink cartridge reaches a predetermined ink supplement number of times, receiving an output signal of said control unit to count a supplement number of times of ink and deciding whether counted result is within the predetermined supplement number limit or more than the predetermined supplement number of times to send a signal to said control unit, receiving a signal indicative of printing number of sheets to stop an engine when said counted result is within the supplement number limit of ink, and receiving a stop signal of the engine to supplement ink or exchange the ink cartridge.

Figure 6:
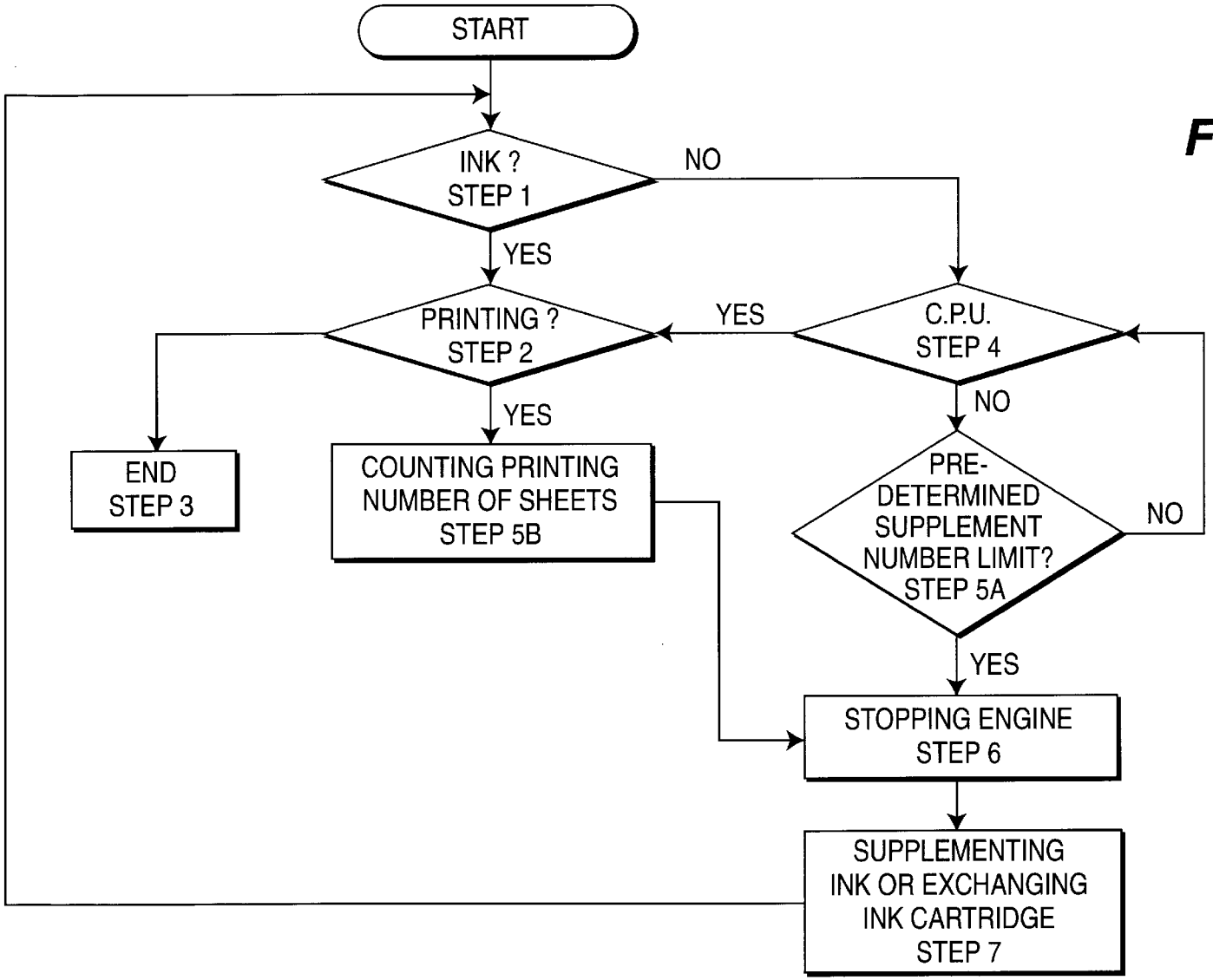
FIGS. 6 and 7 are flow charts illustrating other methods of preventing ink in an ink cartridge from being supplemented more than predetermined number of times according to the present invention.
Figure 7:
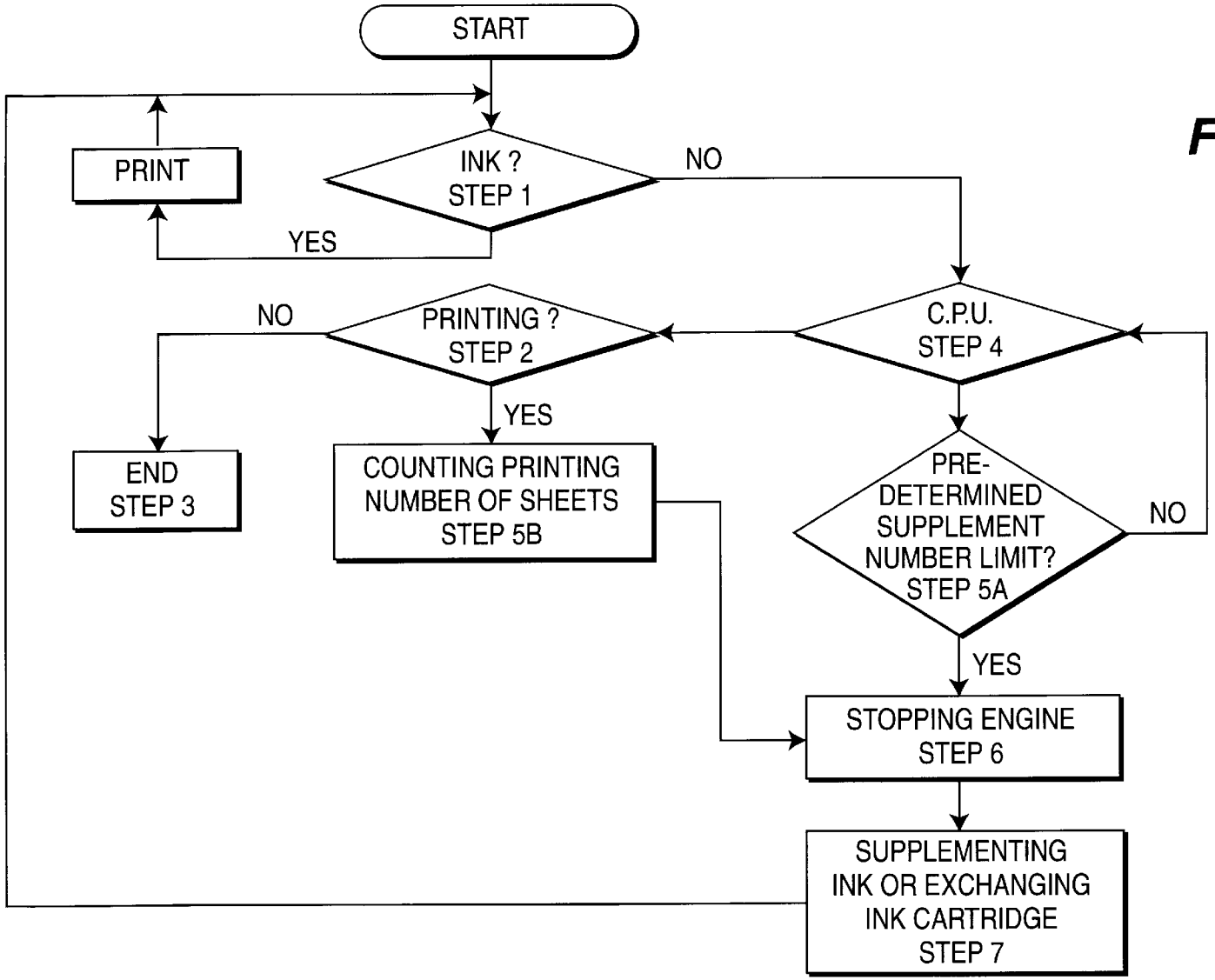

As shown in FIGS. 6 and 7, yet another methods of preventing ink in an ink cartridge from being supplemented more than a predetermined number of times in a printer can include the steps of comparing data to decide whether ink is remaining in the ink cartridge. Sometimes, when the ink remains in the ink cartridge, using a control unit, there can be a deciding whether or not a printing has to be performed. When the printing does not have to be performed, the printing process can end. When the printing has to be performed, there can be a counting the printing number of sheets to decide whether to check whether the ink is remaining in the ink cartridge. Other steps may be counting number of supplements of ink to decide whether a counted result of the number of supplements of ink is within the predetermined number of supplements of ink, and stopping an engine of the printer when said counted result is within the supplement number limit of ink. Other steps can also be included—such as the step supplementing ink; or replacing the ink cartridge; or when the ink does not remain in the ink cartridge, using the control unit, deciding whether to end the printing process.

As described previously, in the present invention, there is an advantage capable of improving reliability of a product by correctly informing the user of an exchange time of the ink cartridge to prevent the ink cartridge from being used more than predetermined life and printing an image of a high quality. Particularly, in the facsimile system, there is an advantage capable of obtaining a correct and stable data.

The present invention as mentioned above has an advantage of being capable of obtaining an image of a high quality and correct data by basically preventing the ink cartridge from being used more than the predetermined utility life and sensing the correct exchanging time, and also has an effect capable of enhancing the reliability of the product by preventing ink from being used more than predetermined supplementing number of times.

It will be apparent to those skilled in the art that various modifications and variations can be made in an ink supplementing device and method of an ink cartridge in a printing apparatus of the present invention without departing from the spirit or scope of the invention. Thus, it is intended that the present invention cover the modifications and variations of this invention provided they come within the scope of the appended claims and their equivalents.

What is claimed is:

1. A device, comprising:

a head for emitting ink onto media;

an ink storing unit for storing the ink, said ink storing unit having a pair of rail guides, said rail guides being positioned within an interior of said ink storing unit;

a pair of spaced-apart electrode terminals each respectively forming a terminal obstruction located at a lower portion of each of said rail guides;

a sensing actuator having a float, said float for exhibiting a buoyancy and for moving said sensing actuator up and down with a surface of the ink within said ink storing unit as said sensing actuator travels along said rail guides in response to a volume of the ink within said storing unit varying in depth, said electrode terminals forming said terminal obstruction for limiting downward movement of said sensing actuator, and said sensing actuator having an electrical conductor for forming an electrical circuit through contact with said electrode terminals as said sensing actuator travels in a downward direction on said rail guides in response to partial depletion of said volume of the ink resulting from said head emitting said ink onto said media;

a resilient mechanism for biasing said sensing actuator to move with said surface of the ink toward said electrode terminals; and an obstacle located at a lower portion of said ink storing unit for engaging said float and for destroying said buoyancy of said float so as to prohibit movement of said sensing actuator in an upward direction upon a substantial and greater depletion of said volume of the ink within said ink storing unit.

2. The device of claim 1, wherein the device further comprises a control unit for connection to said electrical circuit for operatively responding to each occurrence of formation of said electrical circuit through said electrical conductor contacting with said electrode terminals, said each occurrence of formation of said electrical circuit indicating an occurrence of said partial depletion of said volume of the ink, said each occurrence of formation of said electrical circuit being counted by said control unit to prevent said ink storing unit from being used more than a predetermined number of times.

3. The device of claim 1, further comprising:

a sensor connected to said pair of electrode terminals for sensing whether said electrical conductor of said sensing actuator is contacting said electrode terminals;

a control unit for receiving a sensing signal from said sensor, for comparing the sensing signal with data for determining at least one of whether said ink storing unit is to be replaced and whether the ink in the ink storing unit is to be replaced upon receiving the sensing signal, and for transmitting information concerning at least one of whether to replace the ink storing unit and whether to replace the ink in the ink storing unit; and an ink cap enclosing an upper portion of said ink storing unit and having an air hole, said air hole for at least one of permitting air flow to the inside of said ink storing unit for maintaining pressure in said ink storing unit and for injecting the ink into said ink storing unit to replace the ink used by emitting the ink onto said media.

4. The device of claim 1, wherein the float comprises a plurality of floats.

5. The device of claim 1, wherein said float comprises a vinyl resin.

6. The device of claim 1, wherein said resilient mechanism comprises a plurality of tension springs.

7. The device of claim 1, wherein said float has a greater buoyancy than a resilience of said resilient mechanism.

8. A method of preventing ink in an ink cartridge from being replaced more than a predetermined number of times, comprising the steps of:

comparing data by a control unit as to an amount of the ink remaining in the ink cartridge to decide whether the ink is remaining in the ink cartridge;

when the ink remains in the ink cartridge, using the control unit for deciding whether a printing can be performed as a result of said comparing data as to the amount of the ink remaining in the ink cartridge;

when the printing does not have to be performed, the control unit for ending a printing process;

when the printing has to be performed, the control unit counting a number of sheets being printed to decide whether to check whether the ink is remaining in the ink cartridge;

counting by the control unit a number of replacements of the ink resulting from printing the number of sheets to decide whether a counted result of the number of replacements of the ink has reached a predetermined number of replacements of the ink; and stopping printing when said counted result has reached the predetermined number of replacements of the ink.

9. The method of claim 8, wherein the method further comprises the step of replacing the ink when said comparing data indicates a predetermined amount of the ink does not remain in the ink cartridge and said counted result has not reached said predetermined number of replacements of the ink.

10. The method of claim 8, wherein the method further comprises the step of replacing the ink cartridge when said counted result has reached the predetermined number of replacements of the ink.

11. The method of claim 8, wherein the method further comprises the step of when the ink does not remain in the ink cartridge, using the control unit for deciding whether to stop the printing.

12. A device, comprising:

a head for emitting ink onto media;

an ink storing unit for storing the ink having rail guides protruding perpendicularly in relation to a lower portion of said ink storing unit and positioned oppositely inside said ink storing unit;

electrode terminals respectively located at each lower portion of the rail guides, said electrode terminals for sensing whether said ink storing unit contains the ink;

sensing means having a float said float for moving said sensing means up and down with a surface of the ink within said ink storing unit, said sensing means having guide apertures for guiding said sensing means when said sensing means moves up and down on said rail guides with the surface of the ink in response to a level of the ink in said ink storing unit, and said sensing means having a conductor, said conductor of said sensing means for contacting said electrode terminals to provide an indication of a number of times of replacing the ink resulting from said head emitting the ink onto said media;

resilient means for pulling said sensing means when said sensing means moves in a downward direction with the surface of the ink inside said ink storing unit; and destroying means located at a lower portion of said ink storing unit for destroying the float upon replacing the ink as indicated by said conductor of said sensing means contacting said electrode terminals more than a predetermined number of times by discharging air pressure within said float.

13. The device of claim 12, wherein the device further comprises a control unit for sending signals to prevent the ink in said ink storing unit from being replaced more than the predetermined number of times based upon said indication of said number of times of replacing the ink resulting from said head emitting the ink onto said media and resulting from each occurrence of said conductor of said sensing means contacting said electrode terminals.

14. The device of claim 12, further comprising:

a sensor connected to each of the electrode terminals for sensing whether said conductor of said sensing means is contacting said electrode terminals;

a control unit for receiving a sensing signal from said sensor, for comparing the sensing signal with data of said number of times of replacing the ink and of said predetermined number of times upon receiving the sensing signal, and for transmitting information as to whether to replace the ink in said ink storing unit; and an ink cap for enclosing an upper portion of said ink storing unit and having an air hole, said air hole for at least one of permitting air flow to the inside of said ink storing unit for maintaining pressure in said ink storing unit and for injecting the ink into said ink storing unit to replace the ink used by emitting the ink onto said media.

15. The device of claim 12, wherein said float comprises a float globe having an initial air pressure, said initial air pressure being discharged upon occurrence of said destroying means destroying said float.

16. The device of claim 12, wherein said float comprises a thin, vinyl resin.

17. The device of clam 12, wherein said resilient means comprises a tension coil spring.

18. The device of claim 12, wherein said float has a greater buoyancy than a resilience of said resilient means.

* * * * *